United States Patent [19]

Herring

[11] Patent Number: 4,527,095

[45] Date of Patent: Jul. 2, 1985

[54] LAMP CIRCUIT APPARATUS

[76] Inventor: Robert W. Herring, 707 Tropic Hill, Altamonte Springs, Fla. 32701

[21] Appl. No.: 402,717

[22] Filed: Jul. 28, 1982

[51] Int. Cl.[3] ..... H01J 7/44

[52] U.S. Cl. ..... 315/65; 315/68; 315/88; 315/89

[58] Field of Search ..... 315/88, 89, 65, 68

[56] References Cited

U.S. PATENT DOCUMENTS 3,725,728 4/1973 King ..... 315/65

3,855,587 12/1974 Jacobs ..... 315/89

3,964,040 6/1976 Behl ..... 315/89

*Primary Examiner*—Harold Dixon

*Attorney, Agent, or Firm*—William M. Hobby, III

[57] ABSTRACT

A lamp and lamp circuit apparatus are provided in which the lamp has a plurality of filaments operable one filament at a time and driven by a plurality of filament drivers. A filament failure detector circuit is operatively connected to one or more filament drivers for detecting the failure of the filament being driven. A circuit actuates a second filament in the multiple filament bulb when the filament failure detector detects failure of one filament, so that a lantern, and especially flashing lanterns, can have an extended lamp life.

11 Claims, 4 Drawing Figures

LAMP CIRCUIT APPARATUS

BACKGROUND OF THE INVENTION

The present invention relates to lamp circuits and especially to a lamp bulb having multiple filaments driven one filament at a time and controlled to switch filaments upon the failure of a filament.

In U.S. waters, the Coast Guard requires that all off-shore obstructions, such as oil drilling and production platforms, be lighted at night by flashing lanterns which are placed so as to indicate the size and shape of the obstruction. The lanterns must flash synchronously at the rate of once per second, with power applied to lamp filaments for 0.3 second. The flash as seen by an observer must not appear as a point source, since the eye cannot range a point. The Coast Guard also will not permit use of xenon flash tubes for reasons which probably are due to the reaction of the eye to an abrupt flash of very short duration, i.e., it produces a sense of disorientation and cannot be ranged any better than a point.

This has led to use of a common type of lantern having six incandescent lamps mounted on a rotatable turret, so that if one burns out, another may be rotated into place, returning the lantern to service. The change of bulb is automatic, carried out by circuits which detect the broken filament and operate a small motor to rotate the turret.

Positioning of the new bulb is critical, its filament cannot be as much as $\frac{1}{8}$ inch out of place and still have the lantern operate properly. This is because the bulb must be at the center of a Fresnel lens which converts the "point" of light from the filament to a column of light upon which an observer's eye can range. Many thousands are in use in U.S. waters and all over the world. They are, to a point, reliable and they meet Coast Guard requirements, such as being visible from a distance of five miles with the lantern at an elevation of twenty feet, and unattended operation for thirty (30) days.

Their disadvantages, however, are sufficient to warrant a complete redesign. They are poorly sealed against sea air, resulting in severe corrosion of the lamp system and control circuitry, making repairs expensive; they have a motor and moving parts, all of which can be eliminated by modern electronic design; and they are expensive.

The present invention is directed to a lamp having multiple filaments to overcome some of the disadvantages of presently used circuits and in which an electronic circuit detects a filament failure and switches to another, thus providing a reliable, longlasting flashing lamp of greatly reduced cost.

SUMMARY OF THE INVENTION

The present invention relates to a lamp and lamp circuit and especially to a flashing lamp such as used in warning lights on offshore obstructions.

A multiple filament bulb is operable one filament at a time and all the filaments are positioned to approximate a point source from the lamp. A filament failure detector is operatively connected to at least one filament of the multiple filament bulb for detecting failure of the filament and an electrical circuit actuates a second filament driver to drive a second filament in the multiple filament bulb when the filament failure detector detects failure of the filament being driven so that the lamp life is substantially lengthened. Each filament in the lamp has a separate filament driver with the first and second filament drivers connected through a missing-pulse detector and through an AND gate to initiate operation of the next filament. The system includes a clock pulse for actuating the filament drivers to produce a flashing lamp and may include a photo cell relay for dusk-to-dawn operation and a five-volt regulator.

BRIEF DESCRIPTION OF THE DRAWINGS

Other objects, features and advantages of the present invention will be apparent from from the written dre-scription and the drawings, in which.

DESCRIPTION OF THE PREFERRED EMBODIMENT

Figure 1:
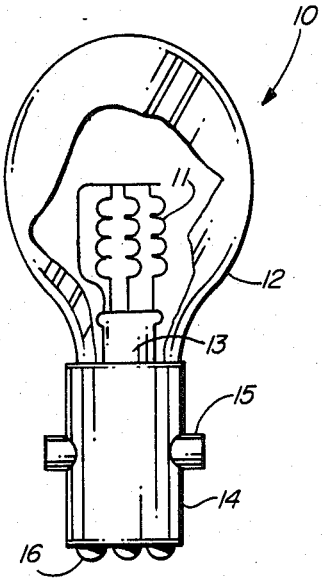
FIG. 1 is a side elevation of a multi-filament lamp in accordance with the present invention.
Figure 2:
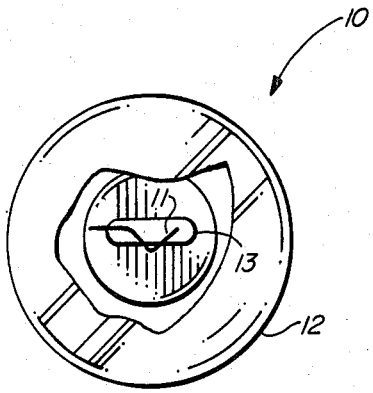
FIG. 2 is a top elevation of the lamp of FIG. 1.

Referring to FIGS. 1 and 2, a multi-filament lamp 10 for use in the present invention is illustrated having three filaments 11 formed in a glass bulb 12 and mounted to an insulator base 13 held in the metal base 14 having a pair of tabs 15 for holding the lamp in a lamp socket and a plurality of electrical contacts 16 formed in the bottom thereof. The filaments 11, as seen in FIG. 2, are placed close together in a triangular position so that each filament will appear to be a point source from the same point in the lamp.

Figure 3:
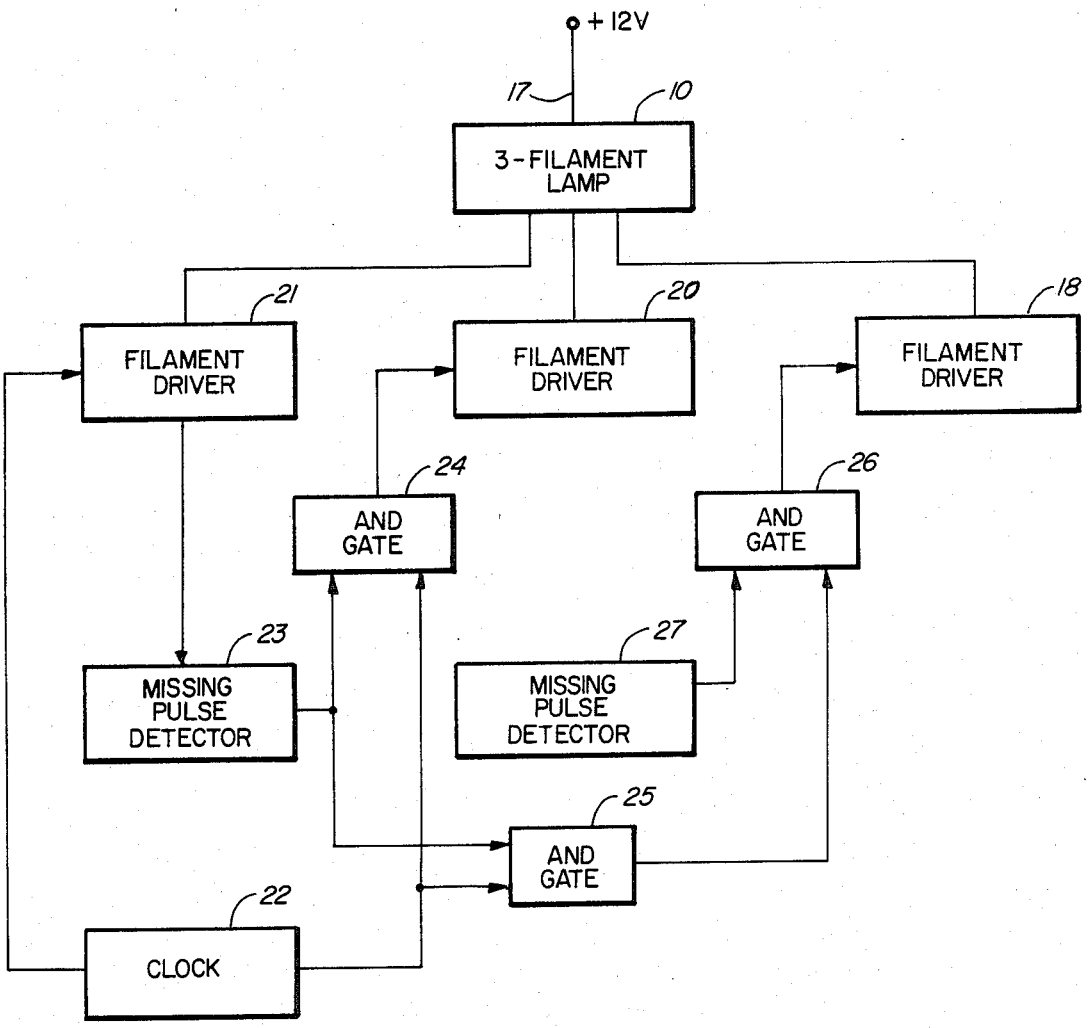
FIG. 3 is a block diagram of a circuit for driving a lamp of FIGS. 1 and 2.

In FIG. 3, the three-filament lamp 10 can be seen connected to a 12-volt source 17 and driven by filament drivers 18, 20 and 21. Filament driver 21 is connected directly to the clock circuit 22 so that the filament being driven by the filament driver 21 begins flashing as soon as the power is applied. Filament driver 21 is connected to a missing pulse detector 23 which in turn actuates AND gates 24 and 25 upon the missing pulse detector 23 detecting a missing pulse and the three-filament lamp being driven by the filament driver 21. Clock circuit 22 is connected to both the AND gates 24 and 25 and AND gate 24 is connected to the filament driver 20 so that actuation of the AND gate 24 will allow the clock pulses 22 to initiate the filament driver 20 and drive the second filament of the filament lamp 10. The AND gate 25 is opened by the missing pulse detector 23 but is blocked by an AND gate 26. When the missing pulse detector 27 connected to the filament driver detects a missed pulse in the second filament, the missing pulse detector 27 then actuates the AND gate 26 to allow the clock pulses to initiate the filament driver 18 to drive the third filament and the filament lamp 10.

Figure 4:
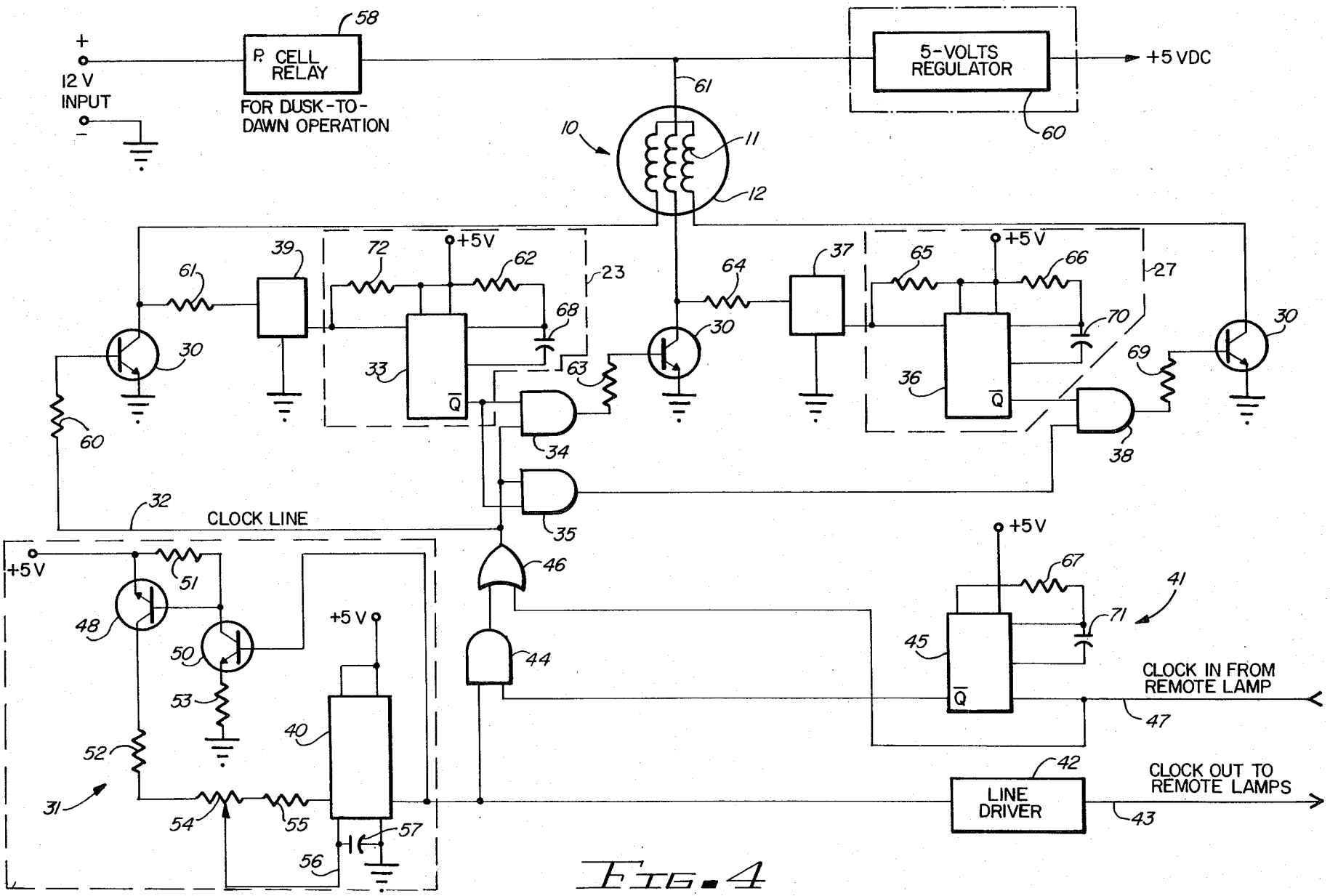
FIG. 4 is a schematic diagram of a circuit for driving a lamp of FIGS. 1 and 2.

Turning now to FIG. 4 of the drawings, the multi-filament bulb 10 having a plurality of filaments 11 in a glass bulb 12 is connected so that each filament is operated by a separate driver transistor 30. The first filament begins flashing as soon as the power is applied, since its driver is connected directly to the clock circuit 31 output line 32. The wave form on this line is a pulse of 0.3 second duration at the rate of one pulse per second. Flashing continues until the first filament breaks or some component associated with it fails. Until this point, a pulse from the filament circuit has been coupled to a missing pulse detector circuit 33. This pulse is derived from the flash current and is coupled via optical coupler 39. The pulse triggers the missing pulse detector, the time constant of which is such that as long as pulses arrive at the proper intervals, the detector remains in its triggered state. The $\overline{Q}$ output of the detector is low in this state and holds closed AND gates 34 and 35. When the filament 11 breaks, no pulse is available to trigger the detector 33 and it reverts to its untriggered state with $\overline{Q}$ high. This enables AND gates 34 and 35 allowing clock pulses from the clock circuit 31 to reach the driver 30 of the second filament which begins flashing.

Operation of the second filament produces pulses coupled to trigger a second missing pulse detector 36 and optical coupler 37 in exactly the same fashion as with the first missing pulse detector 33. At this time, the $\overline{Q}$ output of the second detector 36 goes low, closing AND gate 38, preventing clock pulses from the circuit 31 from reaching the driver of the third filament. If the second filament breaks, the circuit action is identical to that of a broken first filament. The $\overline{Q}$ output of the second missing pulse detector 36 goes high, enabling AND gate 38, thereby allowing clock pulses from the clock circuit 31 to reach the driver 30 of the third filament which begins flashing. It will be clear at this point that this circuit arrangement can be extended to any desired number of filament control stages without departing from the spirit and scope of the invention. The clock circuit 31 is a conventional circuit having an integrated timer 40 modified to permit pulse width adjustments.

It is customary to flash a number of the lanterns in synchronism and this is accomplished in the present invention in the circuit 41. The output of the clock circuit 31 is made available through a line driver 42 and line 43 to operate remote lamp filament circuits with a master clock circuit 31. If the clock 31 is not selected as the master clock, its output is inhibited by an AND gate 44 which is under control of a missing pulse detector 45 identical to those in the filament control circuits. If the incoming clock pulses from the input line 47 fail, the detector 45 will change state, enabling AND gate 44 and allowing local pulses to reach the filament circuit clock line by way of OR gate 46. If no remote clock is connected to the missing pulse detector 45, it will always be in the proper state to enable AND gate 44, allowing the clock line to be driven.

The clock circuit 31 is a conventional circuit having a pair of transistors 48 and 50 with fixed resistors 51, 52 and 53 connected therein and a variable potentiometer 54 connected to a transistor 48 and to the timer 40. Transistor 50 is connected through resistance 53 to ground and one leg of the potentiometer 54 is connected through resistance 55 to the timer 40. Timer 40 is connected to ground. A line 56 is connected from the timer to the potentiometer 54, through the coupling capacitor 57.

A photocell relay 58 and a 5-volt regulator 60 use conventional circuits and may connect to the conductor 61 connected to the filaments 11. The photocell relay produces dusk-to-dawn operation and will operate the lamp circuit in inclement weather if insufficient light conditions occur.

Applicant does not intend that the schematic diagram should limit the operation of the invention, but the following circuit components can be used therein:

| | |
|---|---|
| IC's 33, 36, 45 | ½ of 74123 |

-continued

| | |
|---|---|
| Transistors 30 | TIP 120 |
| AND Gates 34, 35, 38, 44 | ¼ of 7408 |
| OR Gate 46 | ¼ of 7432 |
| Optical Coupler 39, 37 | TIL 111 |
| Driver 42 | MJE 270 |
| Transistor 48 | 2N3906 |
| Transistor 50 | 2N3904 |
| Resistor 51 | 13. k ohm |
| Resistor 52 | 5.1 k ohm |
| Resistor 53 | 4.7 k ohm |
| Resistor 54 | 500 k ohm |
| Resistor 60, 63, 69 | 1000 ohm |
| Resistors 61, 64 | 180 ohm |
| Resistors 62, 66, 67 | 150 k ohm |
| Resistors 65, 72 | 2200 ohm |
| Capacitors 68, 70, 71 | 25 microfarads |
| Capacitor 57 | 2 microfarads |

It should be clear at this time that a specific multi-filament lamp driven by a specific circuit has been provided which allows the lamp to have substantially lengthened flash service and avoid the inherent problems of a motor driven turrent multilamp circuit. It should, however, be clear that the invention is not to be construed as limited to the forms shown, which are to be considered illustrative rather than restrictive.

I claim:

1. A lamp circuit comprising in combination:

a clock circuit;

a multiple filament bulb operable one filament at a time;

filament failure detector means operatively connected to at least one filament of said multiple filament bulb for detecting the failure of the filament, said filament failure detector having at least one missing pulse detector circuit operatively connected between said one filament and an optical coupler circuit for detecting when a clock actuated electrical pulse driving a filament is missed; and means to actuate another filament in said multiple filament bulb when said filament failure detector means detects failure of one filament, whereby lamp life is extended.

2. A lamp circuit in accordance with claim 1, in which said missing detector circuit is connected through an AND gate to a second filament driver driving a second filament.

3. A lamp circuit in accordance with claim 2, in which said second filament driver is connected to a second missing pulse detector which in turn is connected to a second AND gate for actuating a third filament driver for driving a third filament when said second missing pulse detector detects a missing pulse in the said second filament.

4. A lamp circuit in accordance with claim 3, in which said clock circuit is connected through an AND gate actuated by said first missing pulse detector to said second AND gate of said second missing pulse detector.

5. A lamp circuit in accordance with claim 4, in which a photocell relay circuit actuates said lamp circuit only under reduced light conditions.

6. A lamp circuit in accordance with claim 5, in which said lamp circuit is controlled by a 5-volt regulator regulating the voltage to said circuit.

7. A lamp circuit in accordance with claim 1, in which said multiple filament bulb has the three filaments placed to form a triangle in the center portion of said bulb when viewed from its top.

8. A flashing lamp circuit comprising in combination:

a multiple filament bulb operable one filament at a time;

a plurality of filament driver amplifiers, each filament driver amplifier connected to one filament of said multiple filament bulb for driving said filament when said filament driver amplifier circuit is actuated;

clock means connected to one filament driver amplifier for actuating said filament driver amplifier to flash one filament of said multiple filament bulb responsive to clock pulses; and a missing pulse detector connected to said one filament driver amplifier for detecting a missed pulse in the multiple filament bulb filament driven by said one filament driver amplifier and for connecting said clock means to a second filament driver amplifier for flashing a second filament of said multifilament bulb responsive to said clock means pulses, said missing pulse detector being connected to and AND gate and said clock means being connected to said AND gate for actuating a second filament driver amplifier when said missing pulse detector is actuated to open said AND gate whereby said multiple filament bulb continues flashing upon the failure of one filament therein.

9. A lamp circuit in accordance with claim 8, in which said second filament driver amplifier is connected to a second missing pulse detector which in turn in connected to an AND gate and to a third filament driver amplifier connected to a third filament in said multiple filament bulb and said first missing pulse detector is connected to a third AND gate connected to said clock means and said third AND gate is connected to said second AND gate for directing a clock pulse to said third filament driver amplifier responsive to missing pulses being detected in said first and second missing pulse detectors.

10. A lamp circuit in accordance with claim 9, in which said clock circuit is connected through a line driver to a remote lamp circuit.

11. A lamp circuit in accordance with claim 10, in which a remote lamp circuit is connected to said clock circuit.

* * * * *